US006707349B1

(12) United States Patent
Huang et al.

(10) Patent No.: US 6,707,349 B1
(45) Date of Patent: Mar. 16, 2004

(54) DIRECTIONAL COUPLER FOR MICROWAVE CAVITIES

(75) Inventors: Wen-Liang Huang, Hsinchu Hsien (TW); Chih-Chen Chang, Hsinchu Hsien (TW); Jen-Hui Tsai, Hsinchu Hsien (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 10/235,549

(22) Filed: Sep. 6, 2002

(51) Int. Cl.[7] ..... H01P 5/18
(52) U.S. Cl. ..... 333/113; 333/109; 333/161
(58) Field of Search ..... 333/113, 109, 333/115, 116, 135, 137, 157, 161

(56) References Cited

U.S. PATENT DOCUMENTS 2,976,499 A * 3/1961 Sferrazza ..... 333/109
3,721,921 A 3/1973 Lamy et al.
4,211,911 A * 7/1980 Dehn ..... 219/746
4,297,658 A 10/1981 Treczka
4,433,313 A * 2/1984 Saint et al. ..... 333/109
4,792,770 A 12/1988 Parekh et al.
5,043,684 A 8/1991 Downs et al.
5,185,046 A 2/1993 Perez

* cited by examiner

*Primary Examiner*—Robert Pascal
*Assistant Examiner*—Dean Takaoka
(74) *Attorney, Agent, or Firm*—Birch, Stewart, Kolasch & Birch, LLP

(57) ABSTRACT

A directional coupler for microwave cavities is used to guide microwave signal power in both directions. The directional coupler contains a first carrier and a second carrier overlapped with each other, a metal line (such as a micro strip line) between the first and second carriers, a signal connector between both ends of the micro strip line, and a metal shell. The first and second carriers and the micro strip line are made using the print board technology. A copper foil is formed on the circuit board surface of the first carrier to form metal lines (such as micro strip lines). The circuit board surfaces of the first and second carriers are coated with a metal shell by electroplating means. A microwave cavity directional coupler with a simple structure and manufacturing process is thus achieved.

10 Claims, 3 Drawing Sheets

DIRECTIONAL COUPLER FOR MICROWAVE CAVITIES

BACKGROUND OF THE INVENTION

1. Field of Invention

The invention relates to a device for measuring the microwave power inside a waveguide. More particularly, the invention discloses the structure of a micro strip directional coupler for measuring microwave power in different directions inside a waveguide.

2. Related Art

The microwave power needed in a typical microwave heating system is usually hundreds of watts. If one uses a normal microwave power meter to measure the microwave source, the large power output may easily damage the power meter. Therefore, a microwave coupler is often used in this case. The hundreds of watts of microwave power output is coupled with the microwave coupler in such a way that the measured power is only of mW order. The signal coupled by the microwave coupler can be directly read out by microwave power meters. After a systematic conversion, one can obtain the output power of the microwave source.

The microwave heating system is mainly comprised of a power supply, a magnetro, a waveguide, a controller and a cavity. The magnetro is one type of microwave generators. It provides such information as temperature, humidity and weight through detectors, and its output is controlled by a time switch or a feedback controller. The waveguide specifically refers to all kinds of hollow metal waveguides and surface-wave waveguides. Taking a microwave oven as an example, the energy of the microwave generated by the magnetro is transferred in the form of waves through a hollow metal tube to a heating cavity. The microwave coupler is a measuring device for measuring the microwave power.

There are many known microwave couplers. They are consisted of appropriate coupling structures between a main transmission line and an auxiliary transmission line. The transmission line that a directional coupler uses to transmit microwave coupling signals can be a coaxial line, a strip line, a micro strip line, a metal waveguide, or a medium waveguide. The coupling structure can be a coupling hole, a coupling branch line, and a continuous structural coupling.

The techniques disclosed in the U.S. Pat. Nos. 4,297,658, 4,792,770, 5,043,684, and 5,185,046 are mainly waveguide directional couplers that utilize two parallel waveguides. The coupling structure is achieved using several coupling holes or coupling windows or slits. The directional coupler using a metal waveguide often has a high conductivity (e.g. copper, aluminum or stainless steel) in order to minimize the energy loss during the transmission process. Furthermore, the inner walls are as smooth as possible and the metal connecting places are made as few as possible. The cross section of the waveguide can be rectangular or circular. They differ in microwave transmission effects, structural designs, and properties of objects to be heated. They often require more delicate machining and are more difficult in manufacturing.

The technique disclosed in the U.S. Pat. No. 3,721,921 is a directional coupler using a coupling branch structure.

Conventional directional couplers that use strip lines or micro strip lines are of two types. One is a rotational design. It rotates the direction ,of a transmission line so that the transmission line and the coupling hole on the waveguide reach an optimal relative position for coupling. The other is a fixed design. Once the coupler and the waveguide are combined and fixed, the relative position and angle between the transmission line and the coupling hole on the waveguide are unchangeable. The drawback of the rotation-type coupler is in that the structure may become loose and affect the coupling effect.

SUMMARY OF THE INVENTION

An objective of the invention is to provide a new, simple structure of a directional coupler for microwave coupling cavities that is easy in manufacturing.

The manufacturing process of the disclosed directional coupler only involves the steps of making print circuit boards, assembly and electroplating. The step of making print circuit boards is to make the first carrier and the second carrier that contain micro strip lines. The first carrier is implemented by forming a plane copper foil on a fiber substrate. The assembly is to combine the first carrier, the second carrier, and two signal connectors together. The electroplating step covers the surfaces other than the two signal connectors and the position reserved for a coupling hole on the first carrier by a conductive metal (e.g. copper or gold), forming a metal shell.

The micro strip type directional coupler of the invention does not use a hollow metal waveguide structure. Only connectors such as screws are needed to fix the directional coupler on an outer side of the coupling hole of the waveguide. Therefore, the invention is easy to make and install and does not occupy too much space.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

Figure 1:
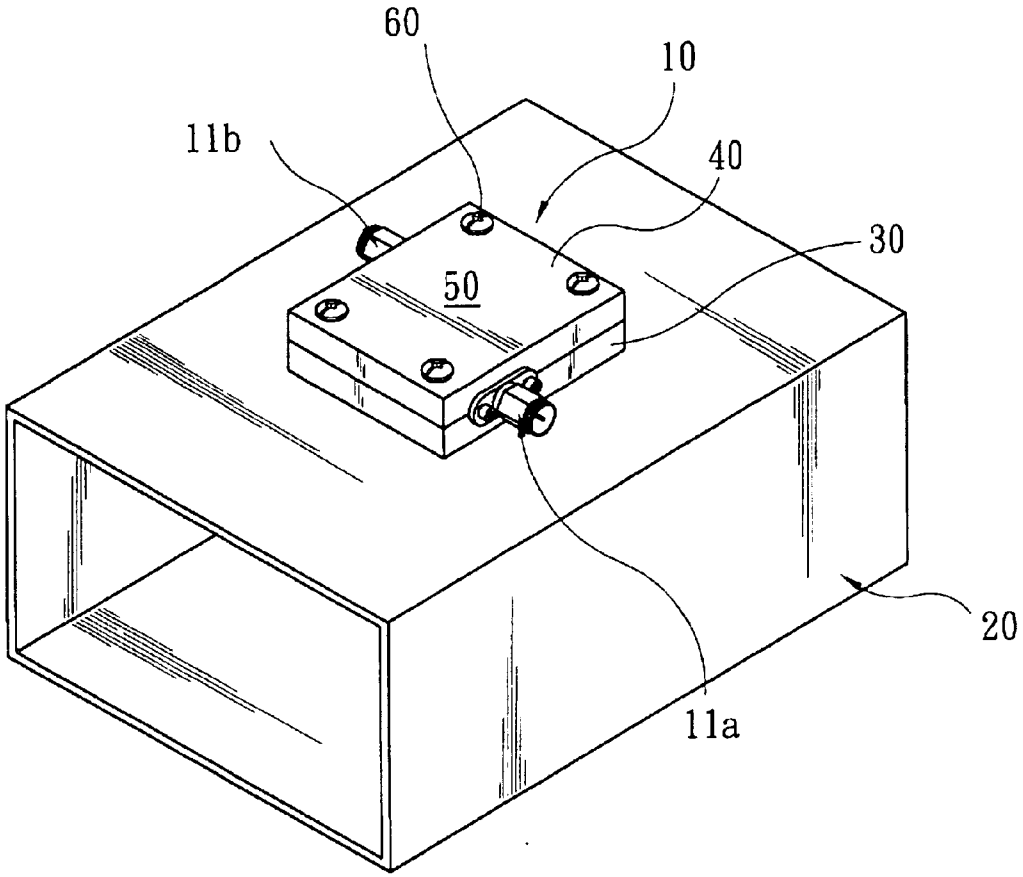
FIG. 1 shows a three-dimensional structure of the invention.
Figure 2:
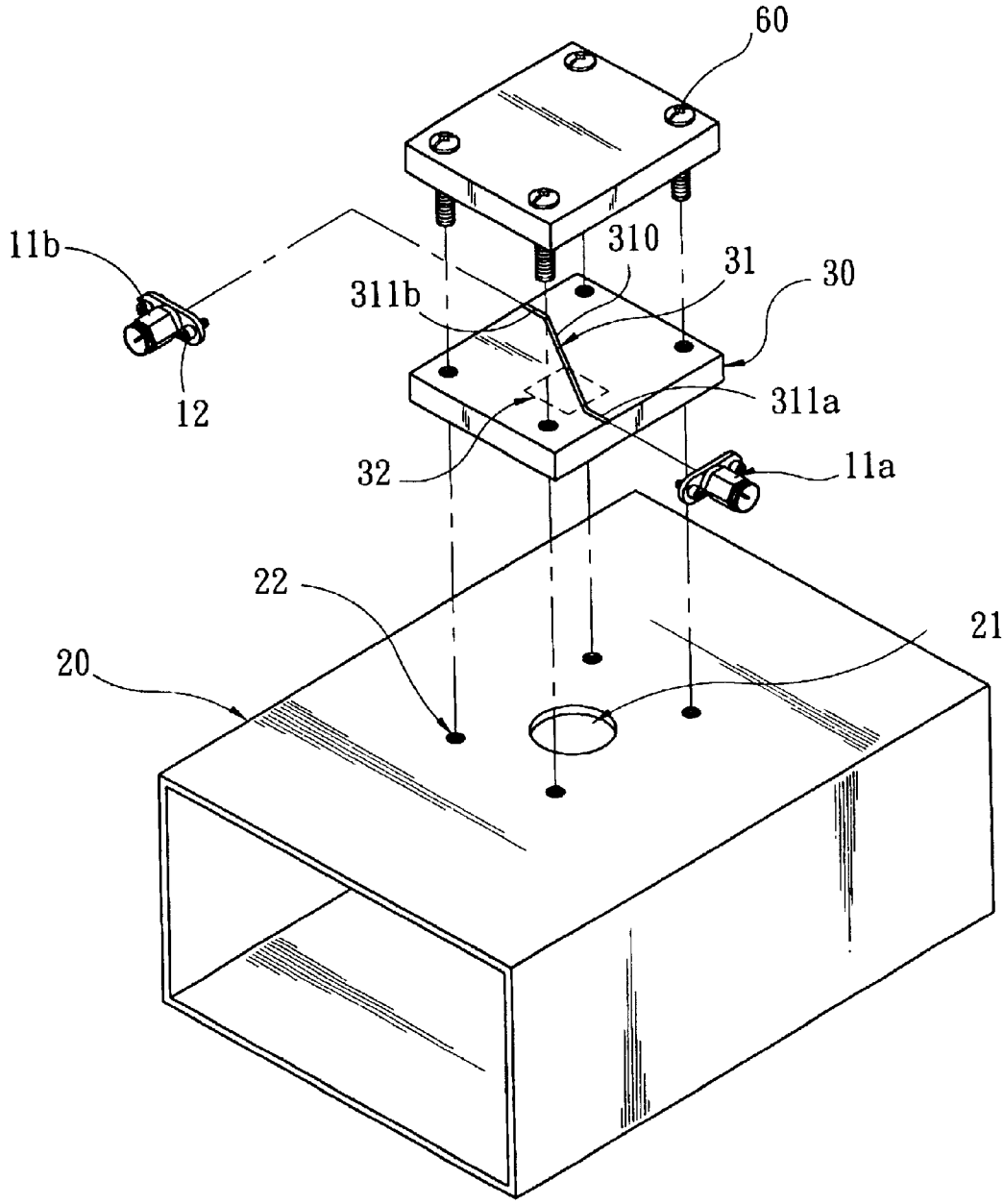
FIG. 2 is an exploded view of the invention.
Figure 3:
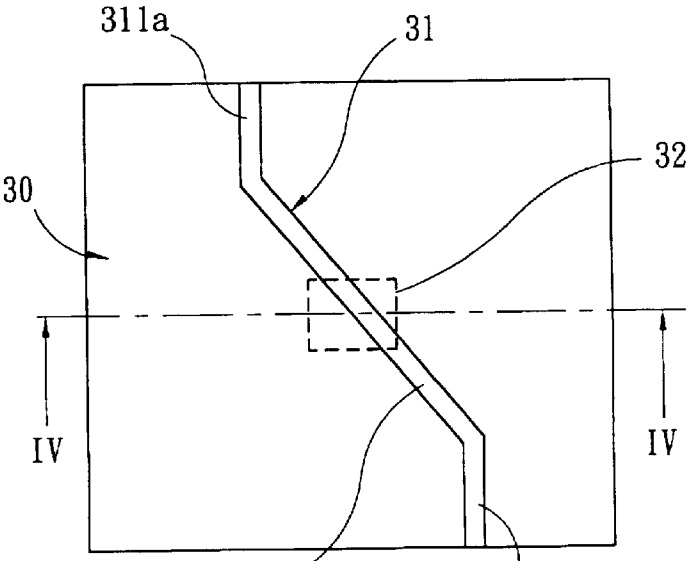
FIG. 3 shows a plane structure of the transmission line in the directional coupler.
Figure 4:
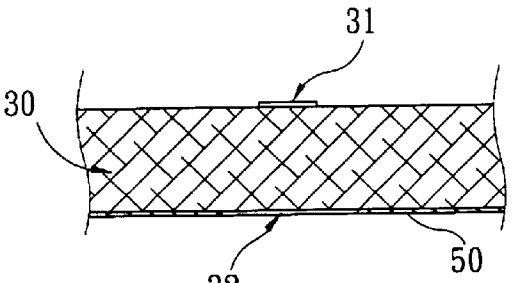
FIG. 4 is a cross-sectional view of the first carrier.

As shown in FIGS. 1 and 2, the disclosed directional coupler 10 is installed on one outer side of the coupling hole 21 on a waveguide 20. With reference to FIG. 3, the detailed structure of the directional coupler 10 includes a first carrier 30, a second carrier 40, a metal layer 50, and a connecting means. The first carrier 30 has a metal transmission line 31 on one of its side surfaces. This transmission line 31 may be a micro strip line or a strip line. According to its function, the transmission line 31 can be divided into a coupling section 310, and a first output section 311*a* and a second output section 311*b* extending from the coupling section 310 to the edge of the first carrier 30. The other side surface of the first carrier 30 has a predetermined rectangular coupling area 32. The coupling area 32 is under the central position of the coupling section 310 and overlaps with the position of the coupling hole 21 on the waveguide 20. The coupling section 310 of the transmission line 31 undergoes microwave signal coupling with the coupling hole 21 of the waveguide 20 through exactly this coupling area 32. The second carrier 40 overlaps and combines with the first carrier 30 and completely covers the micro strip line 31. The metal layer covers the surfaces of the combined first carrier 30 and second carrier 40 except for the coupling area 32. The connecting means fixes the combined first carrier 30 and second carrier 40 on one side of the waveguide 20.

A preferred implementation method of the invention is to make the directional coupler using the print circuit board means. For example, one can take an FR4 glass fiberboard to be the material for the first carrier 30 and the second carrier 40. Then the print circuit board technique is employed to make a layer of thin copper foil lines on the surface of the first carrier 30, forming the transmission lines 31. Afterwards, the second carrier 40 is pressed onto the surface of the first carrier 30, sandwiching the transmission lines 31 in between.

The metal layer 50 covering the surfaces of the first carrier 30 and the second carrier 40 is preferably implemented using electroplating. A layer of conductive metal such as copper or gold is coated on the surfaces of the first carrier 30 and the second carrier 40 to form the metal layer 50. However, the predetermined rectangular coupling area 32 is not coated with any metal. When the directional coupler 10 is installed on one outer side of the coupling hole 21 on the waveguide 20, the coupling area 32 is aligned with the coupling hole 21 on the waveguide 20. In this way, the microwave inside the waveguide 20 is coupled to the transmission line 31 through the coupling hole 21 and the coupling area 32.

A preferred embodiment of the connecting means is to reserve several through-holes 22 on one side surface of the waveguide 20. Screws 60 or other equivalent elements are then used to connect the first carrier 30 and the second carrier 40 of the directional coupler 10 to the through-holes 22 of the waveguide 20. This completes the assembly of the disclosed directional coupler 10.

Since the invention simply uses the print circuit board manufacturing process to make the disclosed directional coupler 10, it is very easy to prepare. One only needs the normal print circuit board procedure along with surface electroplating packaging. As the material used in the invention is the FR4 glass fiberboard commonly used for making circuit boards, it does not contain any metal structure. There is no need of any further machining process, greatly reducing the manufacturing cost.

In principle, the first output section 311*a* and the second output section 311*b* extending to the edge of the first carrier 30 can be connected to a signal transmission cable by welding. Thus, the coupled microwave signal can be transferred to a microwave power meter (not shown) for power measurement.

Another preferred embodiment of the invention is to install on both ends of the directional coupler 10 a first signal connector 11*a* and a second signal connector 11*b* for outputting coupling signals. By connecting these two signal connectors 11*a*, 11*b* to a microwave power meter, the coupled microwave signal can be transferred to the microwave power meter for power measurement. The first signal connector 11*a* is fixed on one side of the combined first carrier 30 and second carrier 40. The signal pin 110*a* of the first signal connector 11*a* is in contact with the first output section 311*a* of the transmission line 31. The second signal connector 11*b* is fixed on the other side of the combined first carrier 30 and second carrier 40. The signal pin 110*b* of the second signal connector 11*b* is in contact with the second output section 311*b* of the transmission line 31.

Figure 5:
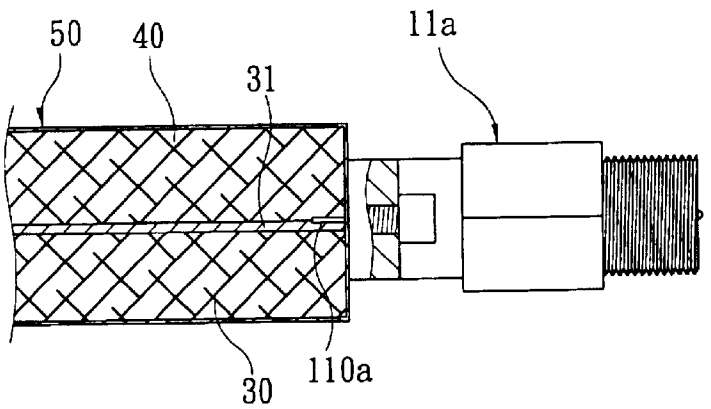
FIG. 5 is a cross-sectional view of the directional coupler.

In a preferred embodiment of the invention, the first signal connector 11*a* and the second signal connector 11*b* are SMA connectors. These two signal connectors 11*a*, 11*b* can be fixed on one side of the combined first carrier 30 and second carrier 40 using screws 12 or other equivalent elements. From FIG. 5, one can see that the signal pin 110*a* of the first signal connector 11*a* is sandwiched between the first carrier 30 and the second carrier 40 and is in contact with the first output section 311*a* of the transmission line 31. Likewise, the signal pin 110*b* of the second signal connector 11*b* is sandwiched between the first carrier 30 and the second carrier 40 and is in contact with the second output section 311*b* of, the transmission line 31.

The assembly of the invention is to first combine the first carrier 30, the second carrier 40, and the first and second signal connectors 11*a*, 11*b* by pressing. The combined element is then electroplated with a metal layer 50. However, the coupling area 32 predetermined at the bottom surface of the first carrier 30, the first signal connector 11*a* and the second signal connector 11*b* do not need to be covered by any metal.

While the invention has been described by way of example and in terms of the preferred, embodiment, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A directional coupler for a microwave coupling cavity installed on an outer side of a coupling hole on a waveguide, the directional coupler comprising:

a first carrier, whose one side surface has a metal transmission line having a coupling section, a first output section extending from one end of the coupling section to the edge of the first carrier, and a second output section extending from the other end of the coupling section to the edge of the first carrier, and whose other surface has a predetermined coupling area located at the central position of the coupling section and overlapped with the coupling hole of the waveguide;

a second carrier, which is overlapped and combined with the first carrier and covers the transmission line;

a metal layer, which covers the surfaces of the combined first carrier and second carrier except for the coupling area; and a connecting means, which fixes the combined first carrier and the second carrier to one side of the waveguide.

2. The directional coupler of claim 1, wherein the transmission line is a micro strip line.

3. The directional coupler of claim 1, wherein both the first carrier and the second carrier are made of an FR4 glass fiberboard and the transmission line is made on the surface of the first carrier using the print circuit board process.

4. The directional coupler of claim 1, wherein the transmission line is a thin copper foil.

5. The directional coupler of claim 1, wherein the metal layer is a copper layer formed through electroplating.

6. The directional coupler of claim 1, wherein the connecting means is to use screws to connect the first carrier and the second carrier onto the waveguide.

7. The directional coupler of claim 1 further comprising a first signal connector and a second signal connector for outputting coupling signals.

8. The directional coupler of claim 7, wherein both the first signal connector and the second signal connector are SMA connectors.

9. The directional coupler of claim 7, wherein the signal pin of the first signal connector is sandwiched between the first carrier and the second carrier and is in contact with the first output section of the transmission line, and the signal pin of the second connector is sandwiched between the first carrier and the second carrier and is in contact with the second output section of the transmission line.

10. The directional coupler of claim 8, wherein the signal pin of the first signal connector is fixed on one side of the combined first carrier and second carrier, the signal pin of the first signal connector being in contact with the first output section of the transmission line, and the second signal connector is fixed on the other side of the combined first carrier and second carrier, the signal pin of the second signal connector being in contact with the second output section of the transmission line.

* * * * *